US007042146B2

(12) United States Patent
Farizon et al.

(10) Patent No.: US 7,042,146 B2
(45) Date of Patent: May 9, 2006

(54) ELECTRON GUN STRUCTURE FOR A CATHODE-RAY TUBE

(75) Inventors: Arnaud Farizon, Chevigny St Sauveur (FR); Philippe Zehnder, Pointre (FR); Christian Galmiche, Pluvet (FR)

(73) Assignee: Thomson Licensing, Boulogne-Billancourt (FR)

( * ) Notice: Subject to any disclaimer, the term of this patent is extended or adjusted under 35 U.S.C. 154(b) by 16 days.

(21) Appl. No.: 10/797,682

(22) Filed: Mar. 9, 2004

(65) Prior Publication Data

US 2004/0212289 A1 Oct. 28, 2004

(30) Foreign Application Priority Data

Mar. 17, 2003 (FR) ..... 03 03220

(51) Int. Cl.
*H01J 29/46* (2006.01)

(52) U.S. Cl. ..... 313/456; 313/451

(58) Field of Classification Search ..... 313/451, 313/446, 456, 277, 279, 285; 315/382, 382.1
See application file for complete search history.

(56) References Cited

U.S. PATENT DOCUMENTS 3,317,770 A * 5/1967 Merchant ..... 313/456
3,772,558 A * 11/1973 Nagao ..... 313/256
3,857,058 A * 12/1974 Nestleroth ..... 313/417
4,071,803 A 1/1978 Takanashi et al. ..... 313/409
4,151,441 A 4/1979 Puhak ..... 313/446
4,468,588 A * 8/1984 Schlack et al. ..... 313/417
5,492,226 A * 2/1996 Hwang et al. ..... 313/446

FOREIGN PATENT DOCUMENTS

DE 2541886 9/1975

* cited by examiner

*Primary Examiner*—Joseph Williams
*Assistant Examiner*—Peter Macchiarolo
(74) *Attorney, Agent, or Firm*—Joseph S. Tripoli; Harvey D. Fried; Richard LaPeruta, Jr.

(57) ABSTRACT

The disclosure describes an electron gun having cathode support structure which comprises an eyelet that surrounds a cathode and is welded to the cathode, and a metal plate 150 substantially parallel to the longitudinal axis of the gun. The metal plate has a central part 152 folded so as to partially surround the eyelet and two side arms 151 extending an each side of the central part and connected thereto by a region 155. The region has, in the direction of the longitudinal axis, a width which is greater than the width of the side arms in the same direction, thereby making it possible to use the same support for the side and central cathodes of a three-beam gun.

7 Claims, 4 Drawing Sheets

FIG.1
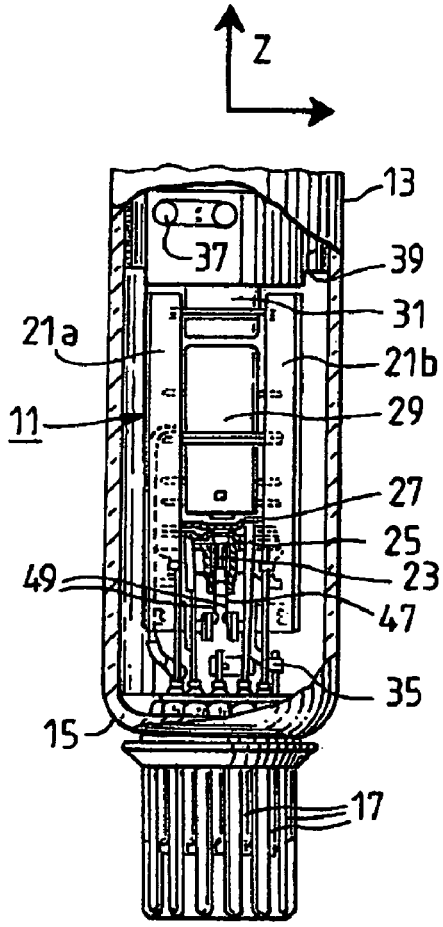
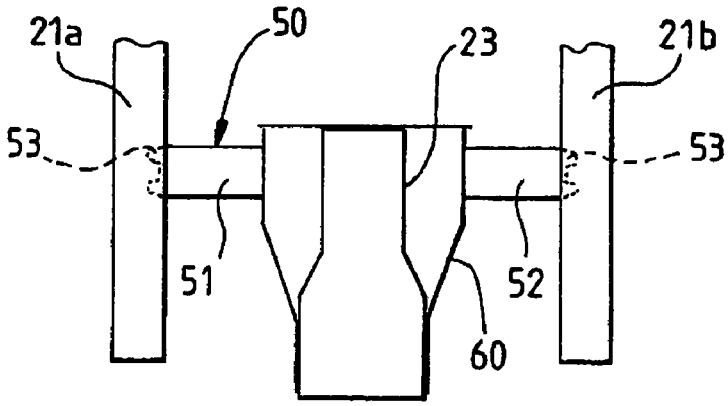
FIG.2

ELECTRON GUN STRUCTURE FOR A CATHODE-RAY TUBE

The invention relates to an electron gun structure for a cathode-ray tube and more particularly to the structure serving as support for the emissive cathode of the said gun.

BACKGROUND OF THE INVENTION

A display device such as a television cathode-ray tube comprises a glass envelope consisting of a faceplate and a funnel-shaped rear part. When the tube is a tube for reproducing colour images, a luminescent screen is placed on the inner surface of the faceplate, the said screen comprising three phosphor arrays corresponding to the three primary colours red, green and blue. An electron gun is placed at the back of the tube, inside a cylindrical neck, in order to generate one or more beams for scanning the screen under the effect of magnetic fields created by a deflection device placed around the tube at the output of the electron gun.

An electron gun for a cathode-ray tube comprises a succession of electrodes for accelerating and shaping the electron beam or beams emitted from one or more emissive cathodes; these electrodes are placed successively along a longitudinal axis.

For tubes designed to reproduce colour images, the gun generally comprises three cathodes placed in line in one and the same direction perpendicular to the longitudinal axis.

Each cathode is placed inside an eyelet to which it is welded. The eyelet, and therefore the cathode, is held in place by means of a metal piece to which it is welded, the said piece comprising two arms whose ends are inserted into two preheated glass beads extending along the longitudinal axis of the gun, the said beads also serving to hold the various electrodes of the gun one with respect to the other.

The electron gun is inserted into the back of the tube into a cylindrical neck whose diameter is minimum so as to optimize the sensitivity of the electron beams to the fields created by the magnetic deflection device.

The cathodes placed in line in one and the same direction have, in this direction, an overall size greater than that of the glass beads in this same direction; in the prior art as, for example, described in U.S. Pat. No. 4,151,441, the arms supporting the side eyelets are identical but different from the arms supporting the central eyelet. It follows that when operating the tube the mechanical and thermal behaviours of the side and central cathodes will not be identical; for example, since the thermal inertia of the central and side supports are different because of the different volumes of metal, the temperature of the cathodes will rise at different rates and therefore reach their nominal rating at different times, thereby causing discolorations of the image during the transient period after the tube is switched on.

SUMMARY OF THE INVENTION

One of the aims of the present invention is to avoid these temperature rise differences of the cathodes by having a cathode support structure which is made lighter compared with the prior art and a substantially identical mass for the side and central supports.

To do this, an electron gun for cathode-ray tubes according to the invention comprises at least one emissive cathode of substantially tubular shape and a cathode held in place using support means comprising:

an eyelet surrounding the cathode and welded thereto a metal plate substantially parallel to the longitudinal axis of the gun comprising a central part folded so as to partially surround the eyelet and two side arms extending on each side of the central part wherein a region connecting the central part to the side arms have, in the direction of the longitudinal axis, a width which is greater than the width of the side arms in the same direction.

BRIEF DESCRIPTION OF THE DRAWINGS

The invention together with its various advantages will be better understood by means of the description below and the drawings among which:

FIG. 1 illustrates, by means of a side view, an electron gun structure for cathode-ray tubes FIG. 2 shows, in section, a cathode and its support means in the electron gun

DETAILED DESCRIPTION OF THE PREFERRED EMBODIMENT

Figure 3:
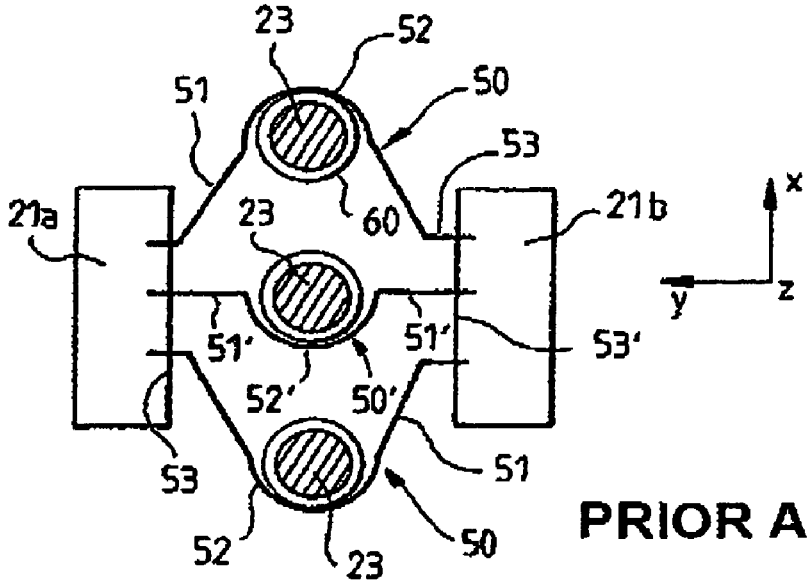
PRIOR ART FIG.3
FIG. 3 shows, by means of a top view, the three in-line cathodes of an electron gun for a coloured tube, together with their support in a structure according to the prior art

FIG. 1 shows an electron gun 11, of the in-line type, placed in the neck 13 of a colour cathode-ray tube. The tube consists of a glass envelope in which a high vacuum has been produced. The neck of the tube is terminated by a base 15 through which the conductors 17 pass, taking the electrodes of the gun to different voltages. The electron gun has a central axis which is coincident with the longitudinal axis Z of the tube and which generates three electron beams having to converge on the screen of the tube. The various successive electrodes (25, 27, 29, 31) of the gun are assembled and held at an exact distance from each other by means of insulating glass beads 21*a*, 21*b* of substantially parallelepipedal shape, their longest dimension extending in the direction of the longitudinal axis Z of the gun; these electrodes are electrically connected to the conductors 17 either directly or by means of strips 35. The gun is centred in the neck of the tube by springs 37 placed on the electrode furthest away from the base, a spring which comes into contact with the inner part of the cylindrical neck.

Three cathodes 23 are placed in line, each one being used as the source of an electron beam. The cathodes are substantially identical, of cylindrical shape, and terminated by a cap on which a layer of emissive material is deposited. A filament 47 is inserted into the cathode and is held in place by means of two lugs 49 also serving to power the said filament.

FIG. 2 shows in detail, by means of a sectional view, a cathode and its support means. The cathode 23 is welded to an eyelet 60 at least partially surrounding the said cathode and the assembly is held in place with respect to the various electrodes of the gun by means of a plate 50 whose central part 52 partially surrounds the eyelet and is welded thereto; the said plate comprises two side arms 51 whose ends 53 are inserted when hot into the glass beads 21*a* and 21*b*.

Figure 4:
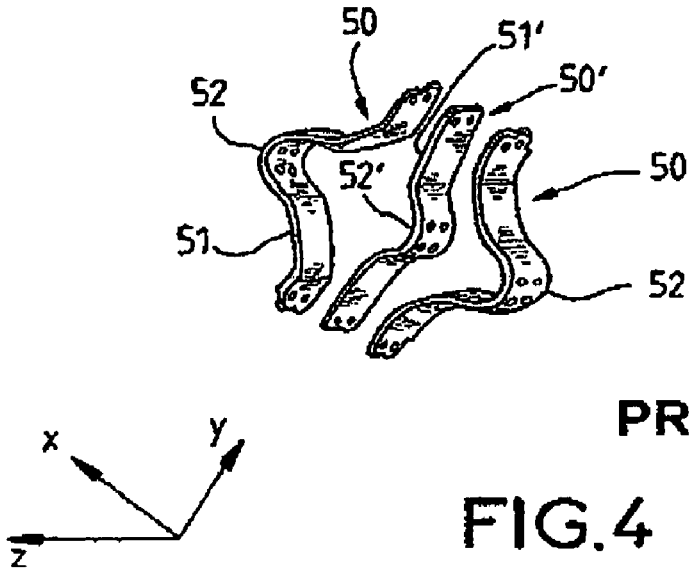
PRIOR ART FIG.4
FIG. 4 shows an isometric projection of the support arms of the three in-line cathodes of FIG. 3

FIG. 3 shows, by means of a top view, the assembly of three cathodes in a gun according to the prior art. For the three cathodes, the eyelets are generally identical but the plates 50 of the end cathodes and 50' of the central cathode have different shapes, shapes shown in more detail in the perspective view of FIG. 4. The plates 50 of the side cathodes and 50' of the central cathode have a surface parallel to the longitudinal axis Z of the gun and have a substantially constant width in the direction of the said axis Z.

For reasons of overall size and spacing between the cathodes, the supports 50 and 50' are different at least in terms of length of the arms connecting to the beads 21*a* and 21*b*. In particular, the arms 51' supporting the central cathode are shorter and terminate in ends 53' placed in the extension of the said arms.

This type of cathode support structure has the following drawbacks:

since the arms do not have the same dimensions and therefore the same volumes for the side and central supports, a temperature rise differential occurs between the central cathode and the side cathodes when operating the tube and this takes place until the temperatures are stabilized at their nominal value. During the transient heating period, the emissions from the central and side cathodes will be different, leading to discolorations of the image generated on the screen of the tube.

since the ends 53' of the central support arms enter the bead while being virtually aligned with the arms themselves, the expansions of the supports 50' due to the temperature rise of the cathode are passed directly to the beads 21*a* and 21*b* while the expansions of supports 50 are partly absorbed by the elasticity of the said supports, elasticity due to the fact that the point of welding to the eyelet and the points of insertion of the ends 53 into the beads are not aligned; these different mechanical forces exerted at this level on the beads lead to problems of mechanical stability and may go so far as to generate cracks in the beads.

Figure 5:
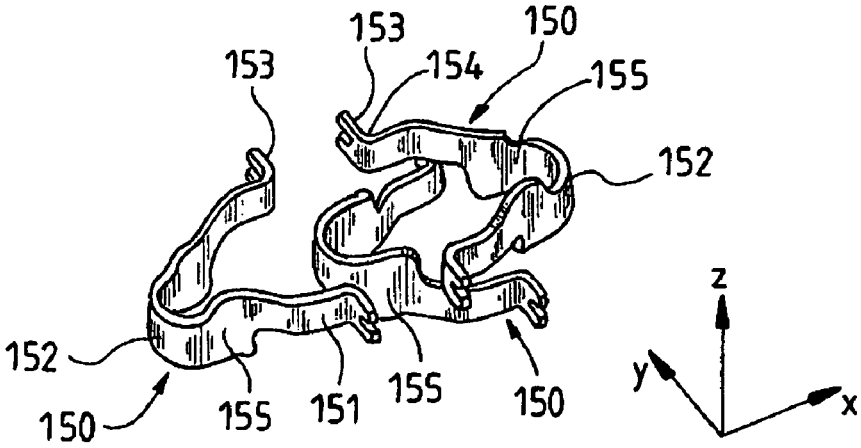
FIG. 5 shows, by means of a view in isometric projection, cathode support arms according to one embodiment of the invention
Figure 6:
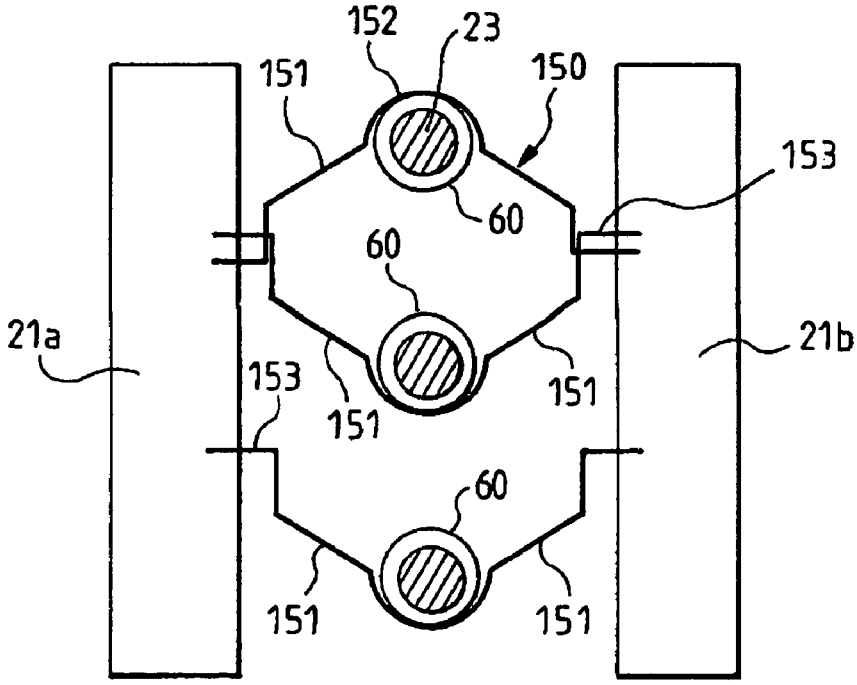
FIG. 6 is a top view of three in-line cathodes of an electron gun for a colour tube, together with their support, in a structure according to the invention

The invention provides a solution to this type of problem, by means of a cathode support structure as illustrated, for example, in FIGS. 5 and 6.

The cathode support means 23 comprise:

an eyelet 60 surrounding the cathode a metal plate 150 placed so as to have a surface which is substantially parallel to the longitudinal axis Z of the gun, the said plate comprising a central part 152 folded so as to partially surround the eyelet and two side arms 151 extending on each side of the central part; the arms 151 are connected to the central part at a connection region 155 whose width L' in the direction of the longitudinal axis is greater than the width of the side arms L" in the same direction.

Figure 7:
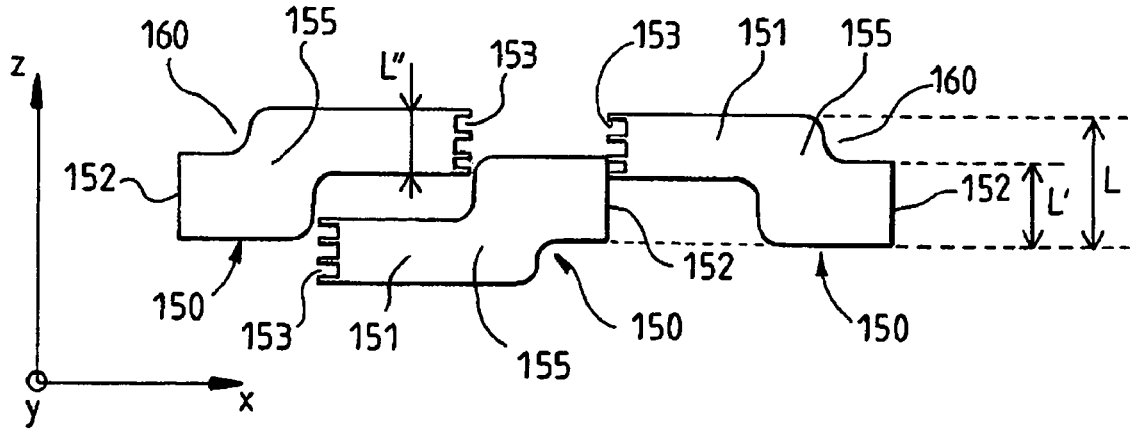
FIG. 7 shows, by means of a side view, the cathode support arms according to one embodiment of the invention.

In this way, it is possible to use the same support means 150 for the three cathodes without noticeably increasing the overall size of these support means in the longitudinal axis Z, as illustrated by the side view of FIG. 7.

To do this, the width L" is less than half the total width of the support 150 in the direction of the longitudinal axis Z of the gun.

In the electron gun according to the invention, the central region 152 is advantageously placed, for the three supports 150, at the same level in the direction of the longitudinal axis Z so that the contact with the cathode eyelet takes place at the same location for the three cathodes, which guarantees, with the fact that the masses of the supports are also similar, identical thermal behaviour during the heating transient.

In an advantageous embodiment, the central region has an indentation 160 in order to decrease the mass of the cathode support used, and therefore to accelerate the rate of temperature rise of the cathodes. These indentations 160 are preferably placed in the extension of the side arms 151 so as to be able to place, as indicated above, the central regions 152 in the same position along the longitudinal axis Z.

The end 153 of the arms 151 is folded so as not to be aligned with the said arm. The angle 154 between the end 153 and the arm is less than 180° and is preferably between 90° and 150°. In this way, the expansions of the supports 150 due to the temperature rise of the cathode when the tube is switched on are not directly passed onto the beads 21*a* and 21*b* thereby causing a risk of generating cracks in the beads; the angle between the end 153 and the arm 151 makes it possible to absorb the expansions of the support 150 by means of the elasticity of the arm 151.

The embodiments described above are not limiting; for example, though keeping generally similar shapes, the side and central cathode supports may be differentiated by their mass so as to take into account the expansion effects of the other electrodes of the gun.

What is claimed is:

1. Electron gun comprising at least one emissive cathode of substantially tubular shape, held in place using support means comprising:

an eyelet surrounding the cathode, and a metal plate substantially parallel to the longitudinal axis Z of the gun comprising a central part folded so as to partially surround the eyelet, this central part having in the direction of the longitudinal axis a width L' and two side arms extending on each side of the central part, the side arms having in the direction of the longitudinal axis a width L" and being terminated by ends folded so as not to be aligned with said arms, said ends being dedicated to be inserted into a glass bead, wherein a connecting region that connects the central part to the side arms has, in the direction of the longitudinal axis, a width L which is greater than the width L" of the side arms in the same direction, wherein the width L' is less than the width L.

2. Electron gun according to claim 1, wherein said gun comprises three emissive cathodes, and said gun comprises the same support means for each of the three emissive cathodes.

3. Electron gun according to claim 1, wherein the width of the side arms in the direction of the longitudinal axis of the gun is less than half the width L of the connecting region of the metal plate in this same direction.

4. Electron gun according to claim 1, wherein the arms comprise, at their end, a part folded so as to form an angle of less than 180°.

5. Electron gun according to claim 1, wherein the central part is indented.

6. Electron gun according to claim 1, wherein an indentation is located in an extension of the side arms.

7. A cathode-ray tube comprising an electron gun, said electron gun comprising at least one emissive cathode of substantially tubular shape, held in place using support means, said support means comprises:

an eyelet surrounding the cathode, and a metal plate substantially parallel to the longitudinal axis Z of the gun comprising a central part folded so as to partially surround the eyelet, this central part having in the direction of the longitudinal axis a width L' and two side arms extending on each side of the central part, the side arms having in the direction of the longitudinal axis a width L" and being terminated by ends folded so as not to be aligned with said arms, said ends being dedicated to be inserted into a glass bead, wherein a connecting region that connects the central part to the side arms has, in the direction of the longitudinal axis, a width L which is greater than the width L" of the side arms in the same direction wherein the width L' is less than the width L.

* * * * *